US005551109A

United States Patent [19]

Tingley et al.

[11] Patent Number: 5,551,109

[45] Date of Patent: Sep. 3, 1996

[54] PILLOW FOR HOLDING AND FEEDING AN INFANT

[76] Inventors: Wayne F. Tingley, 13154 E. Annette St., Moorpark, Calif. 93021; John M. Getzinger, 5629 Laurel Bluff Pl., Agoura Hills, Calif. 91301

[21] Appl. No.: 390,635

[22] Filed: Feb. 17, 1995

[51] Int. Cl.[6] ..... A47D 13/02

[52] U.S. Cl. ..... 5/655; 5/900.5; 5/731; 128/870

[58] Field of Search ..... 5/922, 424, 652, 5/655, 481, 900.5; 128/870–874

[56] References Cited

U.S. PATENT DOCUMENTS

| | | | |
|---|---|---|---|
| 3,729,752 | 5/1917 | Huggins | 128/820 X |
| 3,742,528 | 7/1973 | Münch | 5/900.5 X |
| 4,030,719 | 6/1977 | Gabriele et al. | 5/655 X |
| 4,476,594 | 10/1984 | McLeod | 5/464 |
| 4,580,301 | 4/1986 | Ludman et al. | 5/464 |
| 4,631,766 | 12/1986 | Summler et al. | 5/655 |
| 4,712,258 | 12/1987 | Eves | 5/424 |
| 4,825,487 | 5/1989 | Eberl | 5/900.5 X |
| 5,048,136 | 9/1991 | Popitz | 5/655 X |
| 5,261,133 | 11/1993 | Wilkerson | 5/655 |

FOREIGN PATENT DOCUMENTS

| | | | |
|---|---|---|---|
| 1559851 | 1/1980 | United Kingdom | 5/464 |

*Primary Examiner*—Michael F. Trettel

[57] ABSTRACT

A portable pillow for holding and cradling an infant that can be used by any person desiring to hold, feed, or cuddle the infant. The pillow can be held in a person's arms while sitting or standing, lay comfortably on someone's lap, or be placed on a flat surface, cradling the infant, without the need of holding the pillow. There is a recessed surface where the infant is placed, and overlapping straps that snugly hold the infant within the pillow. The straps are adjustable and held in place with fasteners, such as hook and loop. An inner foam core that is removable from the outer cover is made from two layers of foam with different densities. The top layer is soft for comfort while in contrast the bottom layer is firmer for support and structure. The pillow is portable, lightweight, and easy to hold and carry, therefore it can be used as a portable bed. This will enable the infant to sleep securely and undisturbed, while the pillow is being held or carried.

17 Claims, 2 Drawing Sheets

FIG. 4
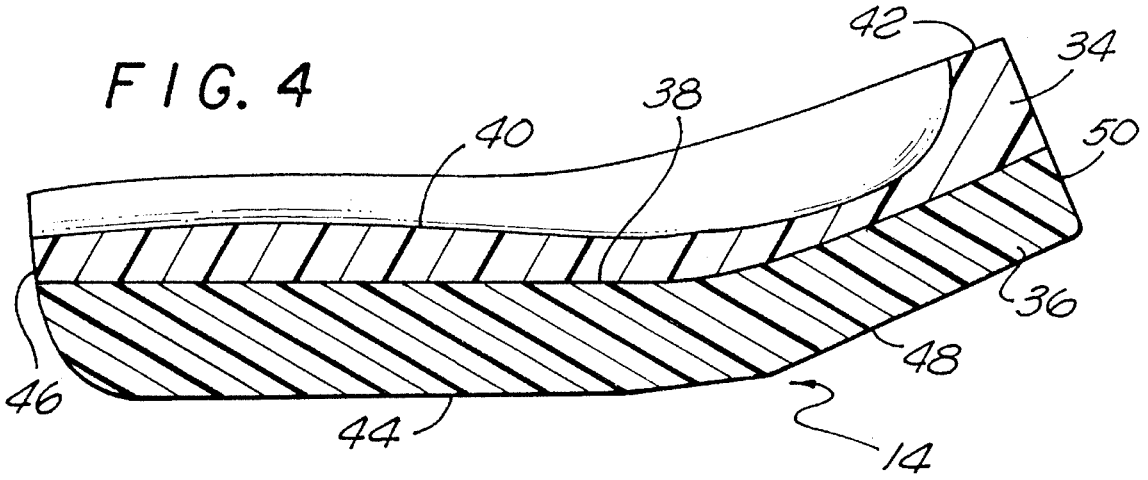
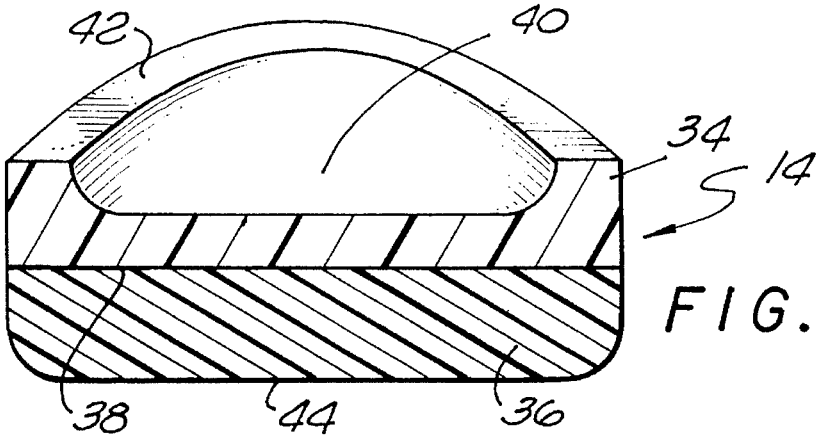
FIG. 5
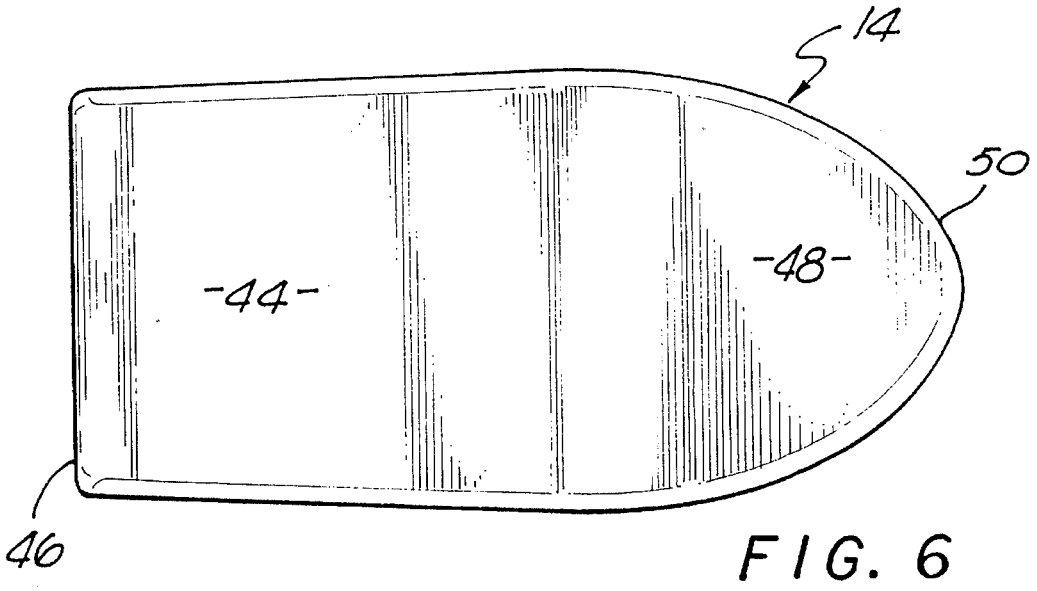
FIG. 6

PILLOW FOR HOLDING AND FEEDING AN INFANT

BACKGROUND—FIELD OF INVENTION

This invention relates to baby pillows, specifically to a pillow designed to hold and cradle an infant while feeding, holding, and interacting with the infant in a variety of ways.

BACKGROUND—DESCRIPTION OF PRIOR ART

Presently, there are several pillows designed for supporting an infant with the purpose of feeding, holding, or in general, cuddling the infant.

One such pillow, which is described in U.S. Pat. No. 5,272,780 to Jason Clute (Dec. 28, 1993) is intended for holding an infant on it's side during sleep. The primary use would be in the infant's crib, and would not be comfortable for someone to hold on their lap. Another support pillow, which is described in U.S. Pat. No. 5,261,134 to Susan H. Matthews (Nov. 16, 1993) is tubular shaped with tapered ends. Since it's generally a tubular shape it would not fit comfortably on someone's lap. The two pillows mentioned above do not promote an easy way for someone to carry, or hold an infant while standing.

Two other pillows designed for nursing are described in U.S. Pat. No. 5,092,005 to Helle Byrn (Mar. 3, 1992) and in U.S. Pat. No. 5,029,351 to Eugene W. Weber (Jul. 9, 1991). Both of these have a cutout section for holding the pillow around a mother's waist during breast feeding. Additionally, two more pillows described in U.S. Pat. No. 5,239,717 to Sue A. Sue (Aug. 31, 1993) and in U.S. Pat. No. 4,393,520 to Coral A. Koch (Jul. 19, 1983) are pads designed to fit onto one's arm. The above mentioned pillows require the action of the user's hands or arms to give additional support to the infant that the pillow does not offer by itself. Lastly a support pad as described in U.S. Pat. No. 5,127,120 to Cynthia A. Mason (Jul. 7, 1992) is designed to be used in conjunction with automobile safety seats, strollers, high-chairs, swings and the like. This pillow will not support an infant in of itself, requiring support from additional apparatus.

Each of these inventions does not, individually, include all the following features: to comfortably place the pillow onto someone's lap while sitting; to comfortably hold or carry an infant while standing; freedom of movement, of both hands and arms, from a person while holding an infant; placing the infant and pillow onto a flat surface, such as a table or chair, without requiring additional support from an individual.

OBJECTS AND ADVANTAGES

Accordingly, several objects and advantages of our invention are to provide a pillow that will accomplish a multitude of functions all contained in one pillow, explained as follows: Our pillow will provide a comfortable and supportive, recessed surface for holding an infant. Our pillow will also provide a comfortable and supportive surface for the person holding the pillow. In addition our pillow will provide a way to comfortably and securely contain the infant onto the pillow's recessed surface. This allows the person holding the pillow to have full use of both hands and arms to pursue other activities and not be a necessary and physical part of the pillow's operation. These features as mentioned give our pillow a variety of applications. Some of these applications would be to use the pillow in settings outside the house, namely at a restaurant, during a church service or other such function, and at any other outdoor activity where an infant could attend, and need to be fed, held, or otherwise cuddled.

Our invention is intended to be used as a portable bed, enabling an infant to be held or carried, without interrupting the infant's sleep. The pillow is portable, lightweight, and easy to hold, allowing it to be used by anyone who is able to hold and feed an infant. This will give other family members, and friends, an opportunity to participate with feeding, holding, cuddling, and nurturing the infant.

Still further objects and advantages will become apparent from a consideration of the ensuing description and accompanying drawings.

BRIEF DESCRIPTION OF THE DRAWINGS

FIG. 4 is a cross-sectional view of the inner foam core taken along line 4—4 of FIG. 3.

FIG. 5 is a cross-sectional view of the inner foam core taken along line 5—5 of FIG. 3.

FIG. 6 is a bottom plan view of the inner foam core.

REFERENCE NUMERALS

Figure 1:
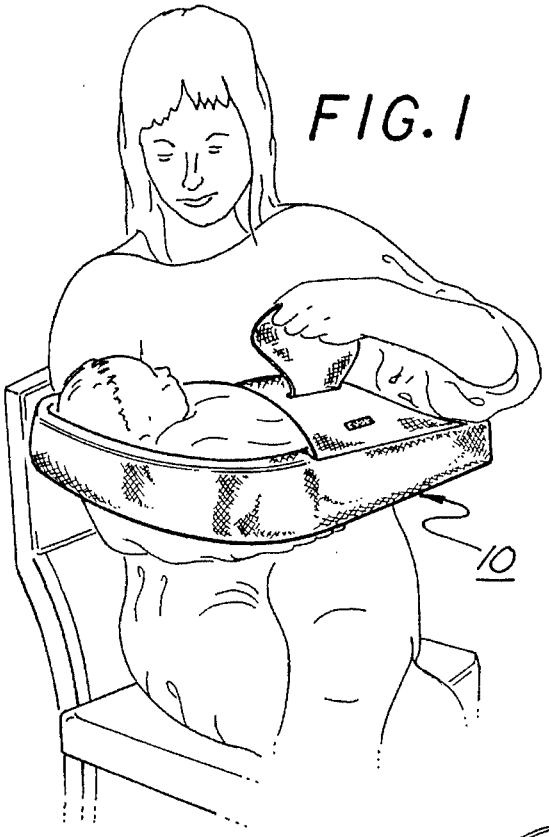
FIG. 1 is a perspective view of our invention, showing a mother holding a baby.

10 pillow assembly
12 cover assembly
14 foam assembly
16 outer cover
18 inner liner
20 sewing line
20A sewing line
20B sewing line
22 left strap
24 right strap
26 slot opening
28 hook fastener
30 loop fastener
32 zipper
34 upper foam layer
36 lower foam layer
38 join line
40 recessed surface
42 top surface
44 bottom surface
46 rear surface
48 inclined surface
50 forward surface

SUMMARY

A pillow for holding and cradling an infant, which can be used as a portable bed, carrying the infant without disturbing the infant's sleep. The pillow comprises a foam assembly approximately the length of an infant's head and body, with a recess on the topsurface of ample depth to receive an infant's head and body. The foam assembly is made from two layers of foam adjoined along a horizontal line. The upper layer is soft and comfortable for the infant, while the lower layer is firmer for structure and support, while also comfortable for someone to place the pillow onto their lap.

There is a cover surrounding the foam assembly made of a suitable fabric, such as cotton, polyester, or a cotton polyester blend. Straps made of the same material as the cover are attached, to secure the infant within the pillow. Hook and loop fasteners are attached to the straps, thus enabling the straps to be securely held in place. Between the foam assembly and the cover lies an inner liner, made of a suitable waterproof vinyl material, preventing fluids, such as an infant's drooling or urinating, from leaking through the cover and onto the foam assembly. The cover is removable from the foam assembly and may be machine, or hand washed. Additionally, there is access to the inner liner for wiping with a towel or sponge, permitting a temporary cleaning when a more thorough cleaning is not convenient, such as when the pillow is used at locations away from the house.

PREFERRED EMBODIMENT—DESCRIPTION

FIG. 1 shows our infant holding and feeding pillow in use, and will be referred to as a pillow assembly 10. This view demonstrates a typical application of pillow assembly 10, with a mother securing an infant into the pillow while resting the pillow onto her lap.

Figure 2:
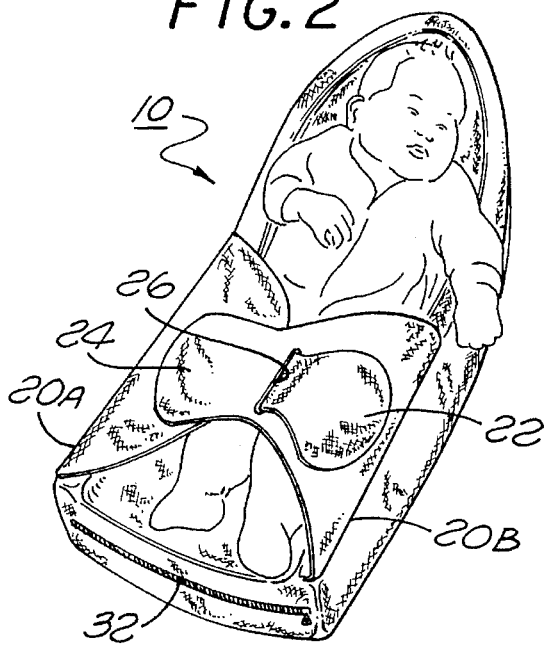
FIG. 2 is a perspective view of our invention, showing an infant securely within the pillow.

FIG. 2 shows a different perspective view of pillow assembly 10. In this view an infant is securely strapped into the pillow, showing how pillow and infant might look while setting on a surface, such as a table, and without the need of someone holding the pillow.

Figure 3:
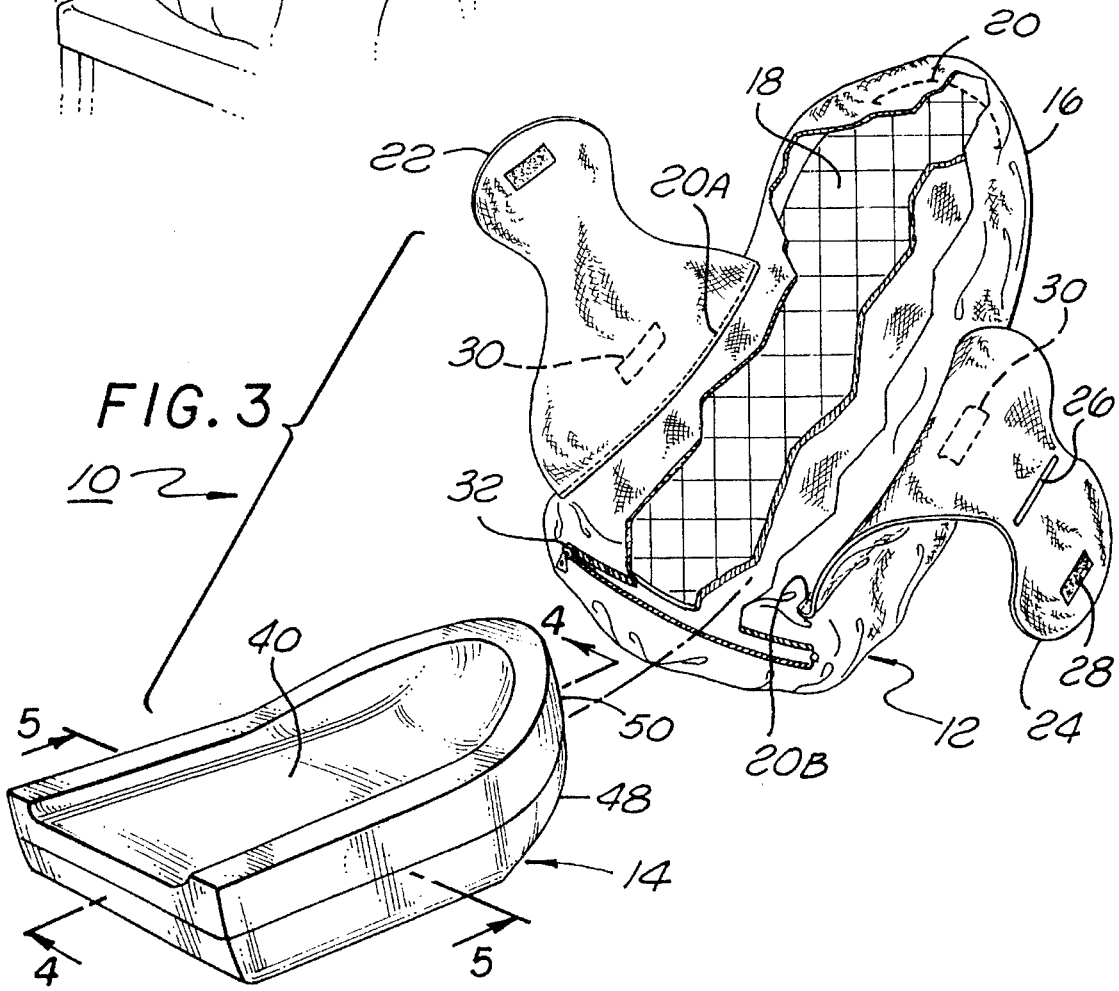
FIG. 3 is an exploded perspective view showing the outer cover removed from the inner foam core. Additionally the outer cover is broken away to display an inner lining.

FIG. 3 is an exploded perspective view showing a cover assembly 12 removed from a foam assembly 14. In the preferred embodiment, the cover assembly 12 would comprise an outer cover 16 made of a soft, washable fabric, such as cotton, polyester, or a cotton polyester mix. Directly beneath outer cover 16, an inner liner 18, made of a leak proof, vinyl material, is attached along a sewing line 20. The length and width of inner liner 18, should extend sufficiently to protect foam assembly 14 from leaking, caused by an infant's drooling or urinating, etc.

Cover assembly 12 has a left strap 22 and a right strap 24, made of the same material as outer cover 16. Both left strap 22 and right strap 24 have a curved design similar to an hourglass shape, which give the straps a symmetrical appearance. Additionally right strap 24 has a slot opening 26 large enough to pass the forward edge of left strap 22 through it, as shown in FIG. 2. Left strap 22 is attached to outer cover 16 along a sewing line 20A and similarly right strap 24 is attached to outer cover 16 along a sewing line 20B. A hook fastener 28 and a loop fastener 30 are attached to each strap and used for securing left strap 22 and right strap 24 to each other while pillow assembly 10 is in use.

There is an opening at the bottom end of cover assembly 12 where a zipper 32 is attached, allowing the removal and replacement of foam assembly 14 from within cover assembly 12.

FIG. 4 shows an upper foam layer 34 adjoining a lower foam layer 36 along a join line 38 using a flexible adhesive material or other suitable means of attachment. Upper foam layer 34 and lower foam layer 36 shall be made of polyurethane foam, although any suitable material could be used. A soft material selected for use in upper foam layer 34 will allow the maximum comfort to the infant. In contrast lower foam layer 36 having a firmer or higher density material will add stability and structure to the pillow.

There is a recessed surface 40 having a contoured shape best shown in FIGS. 3–5. FIG. 4 specifically shows how recessed surface 40 is shaped, with a slight incline to receive the infant's head. FIG. 5 shows recessed surface 40 having a radius at the side walls between recessed surface 40 and a top surface 42. The overall depth of recessed surface 40 as measured from top surface 42 is approximately 1–3 inches deep. There is a bottom surface 44, having generally a planar shape. Contiguous to bottom surface 44 is a rear surface 46 with a rounded edge or radius between them. At a linear distance approximately ⅔ to ¾ the full length of foam assembly 14, an inclined surface 48 abuts with bottom surface 44, and extends the remaining length of foam assembly 14 until intersecting at a forward surface 50. Inclined surface 48 may be constructed as either, one or more interconnecting planar or interconnecting radial surfaces. The intent here is to elevate the forward surface 50 relative to bottom surface 44, producing a more natural shape to hold pillow assembly 10 upon the arm, where upper and lower arm bend at the elbow.

FIG. 5 is a cross-sectional view showing upper foam layer 34 and lower foam layer 36 affixed along join line 38. Depicted here are rounded edges where bottom surface 44 adjoins the left and right extents of foam assembly 14.

FIG. 6 is a plan view showing the preferred outer shape of foam assembly 14 with its contoured design.

PREFERRED EMBODIMENT—OPERATION

The use and operation of pillow assembly 10 is quite simple and straight forward. Place the infant onto the pillow with left strap 22 and right strap 24 hinged outward. Center the infant comfortably within recessed surface 40, shown in FIGS. 3–5. Referring to FIGS. 1–3 pass leading edge of left strap 22 through slot opening 26 of right strap 24. Pull ends of left strap 22 and right strap 24 snugly, then press downward to engage hook fastener 28 to loop fastener 30, thus securing infant within pillow assembly 10. The infant remains cuddled snugly atop the soft restraint of upper foam layer 34. Meanwhile the pillow's shape and support remain intact due to the firmer density of lower foam layer 36. Due to the generally planar shape of bottom surface 44, shown in FIGS. 4–5, pillow assembly 10 will set securely on any suitable flat surface, or comfortably on the holder's lap.

Cleaning of cover assembly 12 is made easy by opening zipper 32, and removing foam assembly 14 from within cover assembly 12. With foam assembly 14 removed, cover assembly 12 can be washed either by machine or by hand. When the pillow is used in locations in which the removal of cover assembly 12 would not be convenient, a temporary cleaning can be accomplished, by opening zipper 32, thereby gaining access to the top side of inner liner 18 shown in FIG. 3. This is made possible by not attaching inner liner 18 to outer cover 16 along surface where zipper 32 is attached. When zipper 32 is then opened you can slide a wash cloth or small sponge between outer cover 16 and inner liner 18, enabling you to clean the top surface of inner liner 18. This temporary cleaning should suffice until a more thorough cleaning may be accomplished by the removal of foam assembly 14 from cover assembly 12.

CONCLUSIONS, RAMIFICATIONS, AND SCOPE

Accordingly, it can be seen that, according to the invention, we have provided an upper foam layer, made of a soft foam material, affording the maximum comfort to the infant. Additionally we provide a lower foam layer, made of firmer or higher density material, which adds support and structure to the pillow, together with comfort and security for the holder. The easily removable and washable cover having a leakproof liner, and overlapping straps to secure the infant, together with the aforementioned foam, result in a very versatile pillow for a variety of applications.

Although the description above contains many specificities, these should not be construed as limiting the scope of the invention but as merely providing illustrations of some of the presently preferred embodiments of this invention. Various other embodiments and ramifications are possible within its scope. For example, some of the articles used throughout the pillow could be substituted, namely zipper 32, or hook and loop fasteners 28 & 30, replaced with snaps, buttons, or any other suitable fastening device. The inner liner 18 could be eliminated and a waterproof treatment could be applied to foam assembly 14 or to outer cover 16 itself. A plastic cover could be sealed firmly around foam assembly 14, enabling the pillow to float, if such an application were desired. Lower foam layer 36 could be replaced with a plastic, injection molded base, or for that matter the entire foam assembly could be made of one piece, rather than two pieces of different densities. The depth of recessed surface 40 could be greater or lesser than 1–3 inches although this depth seams to be the most efficient.

Thus the scope of the invention should be determined by the appended claims and their legal equivalents, rather than by the examples given.

We claim:

1. A pillow for holding and cradling an infant comprising:

a foam assembly approximately the length of an infant's head and body; said foam assembly having a recessed surface of ample depth and width to receive said infant's head and body; said foam assembly having a bottom surface and an inclined surface abutting said bottom surface, said bottom surface having a planar shape, said inclined surface having an acclivity from said bottom surface along an inscribed radial line creating an upwardly curved slope; said foam assembly having a top surface approximately equidistant from said recessed surface, and said top surface approximately equidistant from both said bottom surface, and said inclined surface; said top surface spaced from said recessed surface to give ample depth between said top surface and said recessed surface; said foam assembly being comprised of an upper foam layer and lower foam layer, wherein said upper foam layer and said lower foam layer is of a polyurethane material of different densities; said foam assembly having sufficient thickness between said top surface and both said bottom surface and said inclined surface, to adequately accommodate an infant's weight without undue distortion of said foam assembly.

2. The foam assembly of claim 1 wherein said foam assembly has a cover assembly made of suitable fabric for covering said foam assembly.

3. The cover assembly of claim 2 wherein said cover assembly has straps suitable for containing an infant within said foam assembly.

4. The foam assembly of claim 1 wherein said inclined surface is planar shaped and coplanar with said bottom surface.

5. A pillow for holding and cradling an infant comprising:

a foam assembly approximately the length of an infant's head and body; said foam assembly comprising an upper foam layer adjoining a lower foam layer along a horizontal line; said upper foam layer and said lower foam layer made from materials of different densities, said lower foam layer made from a firmer material than said upper foam layer; said foam assembly having a recessed surface of ample depth and width to receive said infant's head and body; said foam assembly having a bottom surface and an inclined surface abutting said bottom surface, said bottom surface having a planar shape, said inclined surface having an acclivity from said bottom surface along an inscribed radial line creating an upwardly curved slope; said upper foam layer having sufficient thickness to receive the depth of said recessed surface and said lower foam layer having sufficient thickness when combined with said upper foam layer to give said foam assembly sufficient support preventing excessive distortion of said foam assembly during use;

wherein said upper foam layer and said lower foam layer is a polyurethane material of different densities.

6. The foam assembly of claim 5 wherein said foam assembly is combined with a hard plastic support means of similar size and shape as said foam assembly.

7. The foam assembly of claim 5 wherein said foam assembly has a cover assembly made of suitable fabric for covering said foam assembly.

8. The cover assembly of claim 7 wherein said cover assembly has straps suitable for containing an infant within said foam assembly.

9. The foam assembly of claim 5 wherein said inclined surface is planar shaped and coplanar with said bottom surface.

10. An infant support and carrying assembly comprising:

a pre-formed upper support portion made from polyurethane foam having a first density, said upper support portion having a recessed surface, and a pre-formed lower support portion having a bottom surface of planar shape and an inclined surface abutting said bottom surface, said lower support portion having a density substantially different than said first density, whereby said lower support portion is substantially firmer than said upper support portion.

11. The infant support assembly of claim 10 wherein said upper and lower support portions are joined together to form a unitary, integral structure.

12. The infant support assembly of claim 10, including an enclosure encompassing said upper and lower support portions.

13. The infant support assembly of claim 12 wherein said enclosure has a closable opening therein through which said upper and lower support portions can be passed.

14. The infant support assembly of claim 12 wherein adjustable infant restraining Means are attached to said enclosure which can be adjusted to allow an infant a limited degree of movement while preventing the infant from falling out of the assembly.

15. The infant support assembly of claim 14 including waterproof liner means interposed between said enclosure and said upper support portion.

16. The infant support assembly of claim 15 wherein said liner is secured to said enclosure.

17. The infant support assembly of claim 16 wherein said closable opening can be opened to allow access to said waterproof liner for the cleaning thereof.

* * * * *